United States Patent [19]

Compton

[11] Patent Number: 4,903,448

[45] Date of Patent: Feb. 27, 1990

[54] RETRACTABLE HANGERS FOR MOUNTING PRECAST CONCRETE BEAMS AND THE LIKE IN BUILDINGS

[75] Inventor: Lloyd A. Compton, Three Rivers, Calif.

[73] Assignee: Kabo-Karr Corporation of California, Visalia, Calif.

[21] Appl. No.: 383,733

[22] Filed: Jul. 21, 1989

[51] Int. Cl.[4] ..... E04B 1/38

[52] U.S. Cl. ..... 52/252; 52/250; 52/701; 52/702; 403/187; 403/232.1

[58] Field of Search ..... 52/250–256, 52/227, 228, 230, 701–703, 235, 741, 745; 403/187, 153, 232.1

[56] References Cited

U.S. PATENT DOCUMENTS

| | | | |
|---|---|---|---|
| 960,305 | 6/1910 | Gilbreth | 52/252 |
| 976,182 | 11/1910 | Jones | 52/252 |
| 1,957,026 | 5/1934 | Lasker | 52/252 X |
| 3,715,850 | 2/1973 | Chambers | 52/701 |
| 3,733,757 | 5/1973 | Scott | 52/250 X |
| 4,815,895 | 3/1989 | Purssey et al. | 52/250 X |

FOREIGN PATENT DOCUMENTS

| | | | |
|---|---|---|---|
| 777169 | 1/1980 | U.S.S.R. | 52/251 |

OTHER PUBLICATIONS

PCI Design Handbook–Precast and Prestressed Concrete, 3rd Ed., Prestressed Concrete Institute, Chicago, Title Page & pp. 6–35 and 6–36.

*Primary Examiner*—Richard E. Chilcot, Jr.
*Attorney, Agent, or Firm*—Christie, Parker & Hale

[57] ABSTRACT

A precast concrete beam is supported at its end by columns via the agency of retractable hanger arrangements preferably located in cavities at the upper ends of the beam. Each hanger arrangement includes a hanger member which is movable in the cavity from a retracted position within the cavity through a hanger eye device to an extended position in which the hanger member engages the eye device at an upper central portion of the hanger member and in which the hanger member extends in cantilever manner into a recess defined in the adjacent column. In its extended position, the hanger member has its opposite ends supported on bearing plates located in the cavity and in the recess. The hanger eye device is structurally tied into the beam for carriage and transfer to the beam of the support forces for the beam and of forces arising from loads applied to the beam in use.

19 Claims, 5 Drawing Sheets

RETRACTABLE HANGERS FOR MOUNTING PRECAST CONCRETE BEAMS AND THE LIKE IN BUILDINGS

FIELD OF THE INVENTION

This invention concerns the mounting of precast concrete beams and the like to columns and other supports in the construction of structures using precast concrete components. More particularly, it pertains to a retractable hanger arrangement for load supporting and transferring connection of a precast concrete beam to a column or the like in an improved way.

BACKGROUND OF THE INVENTION

Buildings and building systems which use precast concrete structural members are well known. Common components of such buildings and systems are precast concrete beams and columns. Very often, if not usually, precast concrete beams are supported at their opposite ends by concrete columns, or by walls or other parts of the building, defined to receive and support beams. It is well known, even conventional, to support a precast beam between concrete columns by engaging the lower end surfaces of the beam on haunches or ledges formed on the columns as projections which extend laterally from the vertical surfaces of the columns. The weight of the beam and of other building components supported by the beam, and other loads applied in use of the building to the beam and the components supported by it, are carried through the haunches to the columns and by the columns to the column foundations, footings or piers on or in the ground. The beam, as so supported on the columns haunches, is tied into other parts of the building in known ways.

It is now perceived that the common and widespread manner, described above, of supporting precast beams on concrete columns, while reliable and effective and well accepted, does not constitute the best way to provide the necessary beam support. The column must be cast to provide the beam supporting haunches. The forms required for the casting of such columns are more complex and costly than the forms needed for casting simple columns having no haunches; the added complexity and cost is due to the recess which must be present in the column form for the definition of each haunch. The arrangement of reinforcing members embedded in cast columns in the vicinity of a beam support haunch is more complex and costly than for a simple column having no haunches; the added complexity and cost is due to the need to extend substantial portions of the column reinforcing members from locations centrally within the column into the haunches so that loads applied to the haunches can safely be carried into the column itself.

Further, the beam supporting haunches on the column are lateral appendages on the column. The result is that use of column haunches to receive beam loads causes such loads to be applied eccentrically to the column. An eccentrically loaded column is not as strong as the same column when axially loaded, and so an eccentrically loaded column needs more internal reinforcing than does a column designed for the same load applied axially to the column, and the increased internal reinforcement is reflected in the cost to make such a cast column.

Also, when a conventional precast beam is first placed on the haunches of a pair of supporting conventional columns and has not yet been tied into place with other structures, the beam can present a potentially hazardous situation as it merely sits on the column haunches. The beam can be bumped and dislodged from its supports as other parts of the building are moved into place. In that event, workers in the area can be injured, and the beam can be damaged.

It is seen, therefore, that a need exists for an improved way to mount a precast concrete beam to a supporting member such as a cast concrete column or other relevant component of a building of which the beam is a part. This invention addresses that need in a way which has several significant advantages over conventional connections of precast concrete beams to cast columns and the like.

SUMMARY OF THE INVENTION

This invention, in its structural and procedural aspects, provides an improved connection of a precast concrete beam, for example, to a concrete column or the like in a building. The improved connection avoids the use of haunches on columns. The improved connection causes the load of the beam, and of loads carried by the beam, to be applied to the column within the perimeter of the column so the column is much more axially loaded. These two properties of the invention enable the column to be fabricated with less labor, simpler forms, and simpler and, perhaps, less internal reinforcement, and so with less cost. The improved connection also provides an immediate positive connection to the structure supporting the beam, which means that if the beam is bumped before it is tied into other structure in the building, the beam is far less likely to be dislodged from its supported position and become damaged or cause injury to persons in the area.

Generally speaking, in structural terms, a hanger arrangement for load transferring connection of a reinforced precast concrete beam and the like to a reinforced concrete column and the like comprises such a beam and, at least at one end of the beam, a hanger member. The hanger member is movable in a cavity in an end portion of the beam between a retracted position, in which the hanger member is disposed in the cavity, and an extended position in which an end portion of the hanger member extends in cantilever manner from the cavity and the end of the beam for bearing upon a selected feature in a recess in a column, for example, to which the beam is connectible. The beam includes in the cavity, for cooperation with an upper central portion of the hanger member in the extended portion of the hanger member, a hanger eye member. The hanger eye member is coupled in fixed load bearing relation to the beam. The eye member defines an opening in which the hanger member is movable in movement from its retracted to its extended position. The beam also defines in the cavity a bearing plate which is engageable with an underside of the hanger member, in the extended position thereof, adjacent an opposite end of the hanger member.

DESCRIPTION OF THE DRAWINGS

The above-mentioned and other features of this invention are more fully set forth in the following description of the presently preferred and other embodiments of the invention, which description is presented with reference to the accompanying drawing, wherein:

FIG. 1 is a simplified cross-sectional elevation view of a hanger arrangement according to this invention in which the hanger arrangement supports a reinforced concrete beam on a column or the like;

DESCRIPTION OF THE ILLUSTRATED EMBODIMENTS

Figure 1:
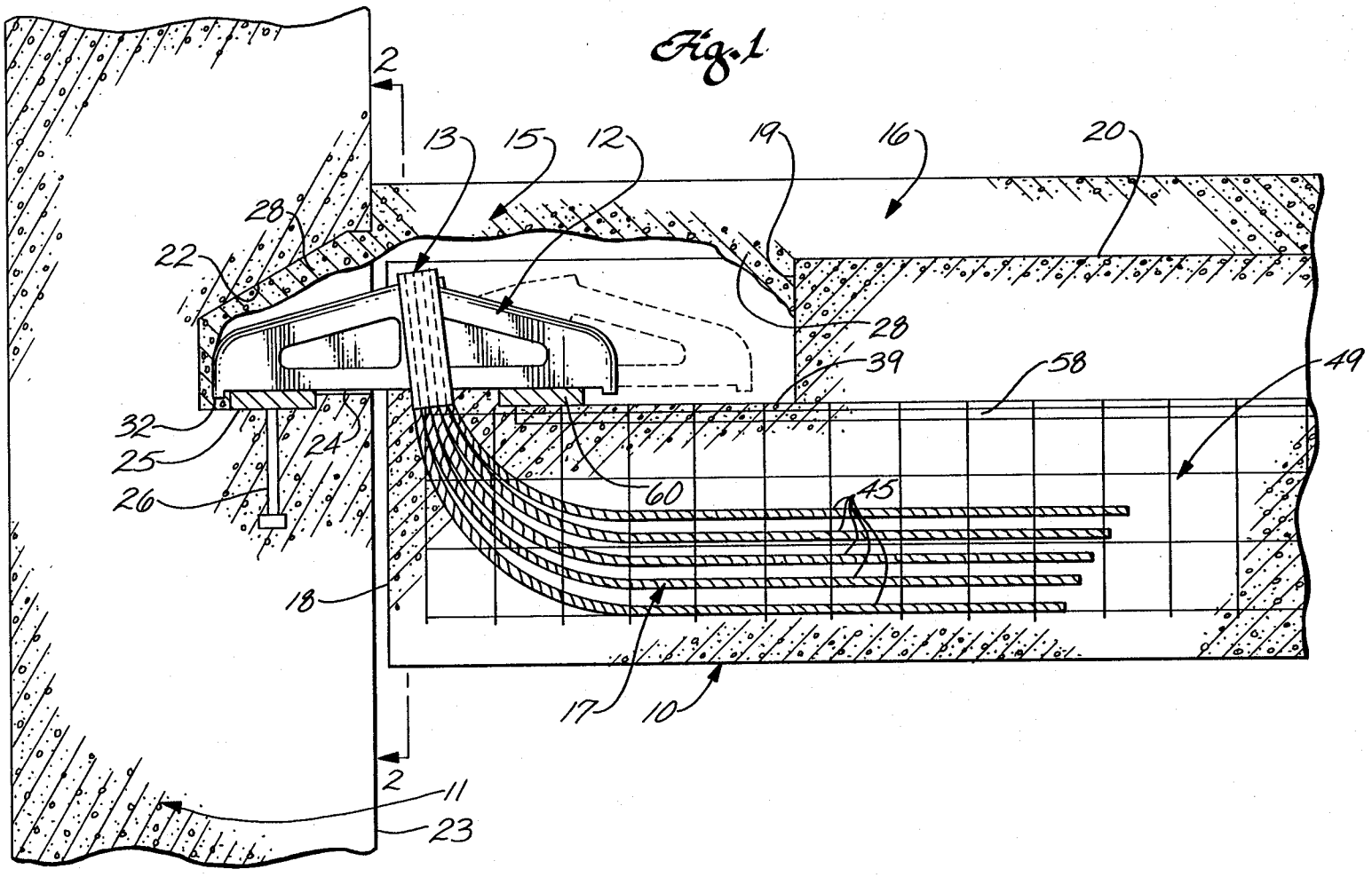
Figure 2:
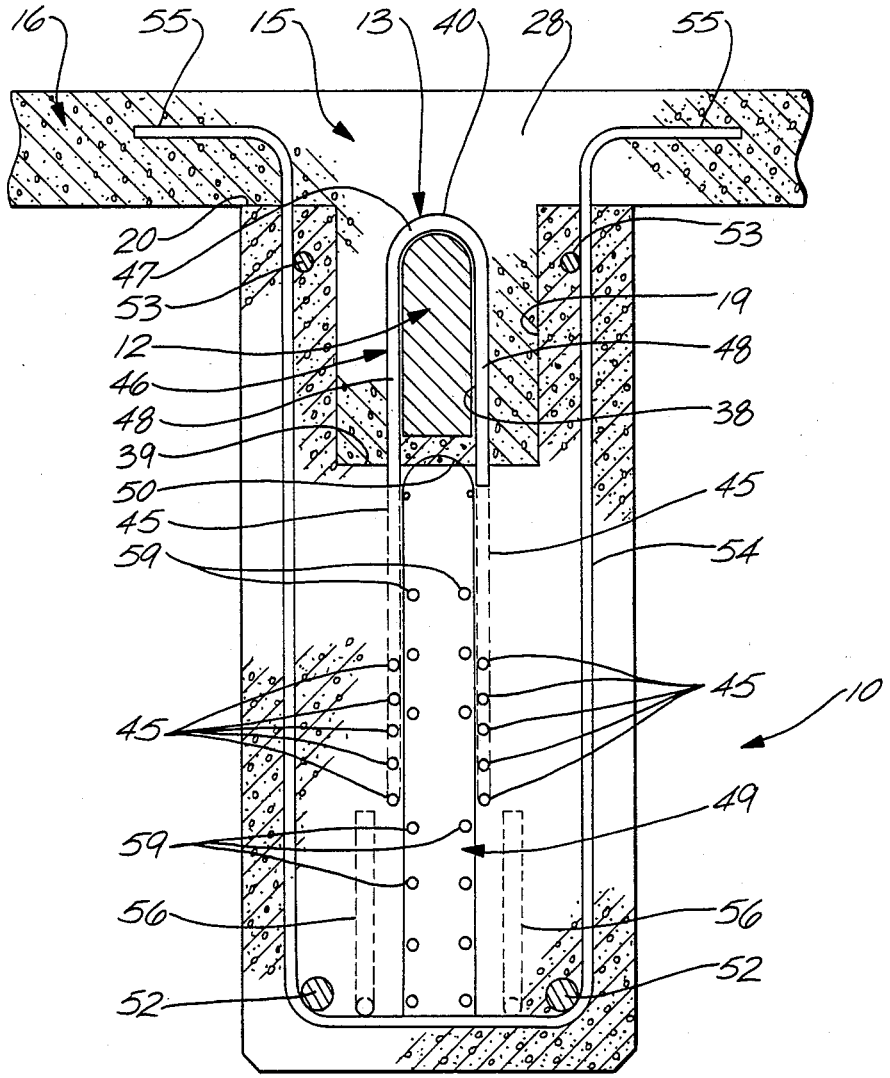
FIG. 2 is an enlarged simplified cross-sectional elevation view taken along line 2—2 of FIG. 1.

FIG. 1 is a simplified cross-sectional elevation view which shows a precast, prestressed, reinforced concrete beam 10 supported by a column 11 via a hanger member 12 and a hanger eye device 13 according to a presently preferred embodiment of this invention. The hanger member, the hanger eye device, and load transfer means 17 associated with the hanger eye device, as more fully described below, are components of a beam hanger arrangement 15 provided by this invention. As shown in FIG. 2, beam 10 can be of rectangular cross-section with its depth being greater than its width.

FIGS. 1 and 2 are simplified from true cross-sectional elevation views of beam 10 and column 11 in that, in FIGS. 1 and 2, substantial portions of the networks of reinforcing bars and other reinforcing elements embedded in the concrete defining the beam and the column have been omitted for clarity of illustration of the structures more directly related to and forming a part of the present invention. Except as specifically noted in the following descriptions, the details of the definition and arrangement of the reinforcing networks within the beam and the column are not parts of this invention. Those aspects of the design and construction of reinforced concrete beams and columns are within the talents of designers of such building components. Such designers are familiar with the ways in which the sizing, number and placement of such networks and their various elements are dependent upon the design loads pertinent to such building components and upon the overall geometries of those components. Therefore, the general and detail aspects of the internal reinforcement of beam 10, column 11 and a floor slab 16 supported by the beam are design variables which may be treated by a competent designer independently of the structures provided by or directly associated with this invention. It will be appreciated, however, that inasmuch as hanger arrangement 15 is called upon in use to support the relevant portion of the dead weight of beam 10 and floor slab 16, as well as the loads applied to the floor slab during use of the structure in which the hanger arrangement is present, the materials and geometries of hanger member 12, of eye device 13 and of load-transfer means 17 will necessarily reflect the dead and live loads mentioned above.

FIG. 1 shows a finished connection of beam 10 to column 11 by use of hanger arrangement 15 and with a poured-in-place floor slab 16 which, although not shown, has its own internal reinforcement, as is well known. It will be observed that the connection of beam 10 to column 11 does not rely upon a laterally projecting ledge or haunch defined by column 11 and upon which a lower end surface of the beam is supported. Instead, the support of the beam by the column is provided by cooperation between the beam and the column of hanger member 12 which extends in cantilever manner beyond a beam end surface 18 from a cavity 19 which preferably is defined in an upper surface 20 of the beam. The hanger member extends from the beam into a recess 22 which is defined in a side surface 23 of the column facing toward the beam. Recess 22 is defined at that location along the height of the column which is appropriate to the correct positioning of the beam on the column. Within column recess 22 a lower surface 24 of the hanger member preferably rests directly upon and is supported by a metal bearing plate 25 which is secured in the column by a suitable anchor 26 embedded in the concrete of the column and welded or otherwise suitably connected to bearing plate. It will be appreciated that the internal reinforcing network (not shown) embedded within column 11 is defined in the vicinity of recess 22 for effectively receiving and transferring into the body of the column the dead and live loads applied to the column by the hanger member during use of the completed building of which the beam and the column are components.

FIG. 1 also shows that when slab 16 is poured in place upon beam 10, as the beam is supported on column 11, the concrete which is poured for formation of the floor slab fills beam cavity 19 and column recess 22 due to the preferred location of cavity 19 in a central part of an end portion of beam top surface 20. FIG. 2 shows cavity 19 located centrally of the width of beam 10 in the beam upper surface 20.

An examination of FIG. 1 shows that, in the completed connection of beam 10 to column 11, hanger member 12 is loaded substantially as a simply-supported beam carrying a concentrated load at about its midlength. As shown best in FIGS. 3 and 4, the geometry of the hanger member preferably is defined in a manner akin to the design of a simply-supported, centrally loaded, uniformly stressed beam. Thus, hangar member 12 is deeper in a vertical direction at about its midlength than it is at its ends while being of substantially constant width along its length between a column end 30 and a beam end 31. The hanger member has a substantially flat bottom surface 24 between projections 32 and 33 which depend from the hanger member at its column and beam ends, respectively, across the width of the hanger member. The presently preferred hanger member 12 shown in FIG. 3, when seen in side view, is of generally triangular shape truncated at its base ends. The hanger member has sloping top surfaces 34 and 35 which rise from the column and beam ends, respectively, toward the center of the hanger member. However, hanger member top surfaces 34 and 35 preferably do not meet at a point at the upper center of the hanger member but instead preferably connect to a sloping, transversely rounded, wedge portion 36. Wedge portion 36 has a top surface 37 which is sloped toward the column end of the hanger member at an angle which preferably is less than the slope of hanger member top surface 34 between the wedge portion and the column end of the hanger member.

The angle of slope of wedge portion top surface 37, and also the contour of surface 37, preferably conform to the slope and contour of the upper portion of a central opening 38 (see FIG. 2) defined by hanger eye device 13. As shown in FIG. 1, the hanger eye device preferably is tilted in beam cavity 19 toward beam end surface 18 as it extends upwardly in the cavity from a cavity bottom surface 39 to an upper end 40 which preferably is located below or about in the plane of beam top surface 20; see FIG. 2. Opening 38 extends from the cavity bottom surface to the underside of the upper end of the eye device.

Figure 4:
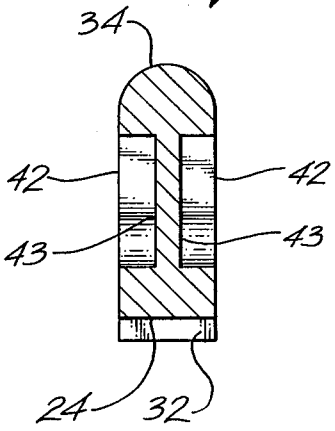
FIG. 4 is a cross-section view taken along line 4—4 of FIG. 3.
Figure 3:
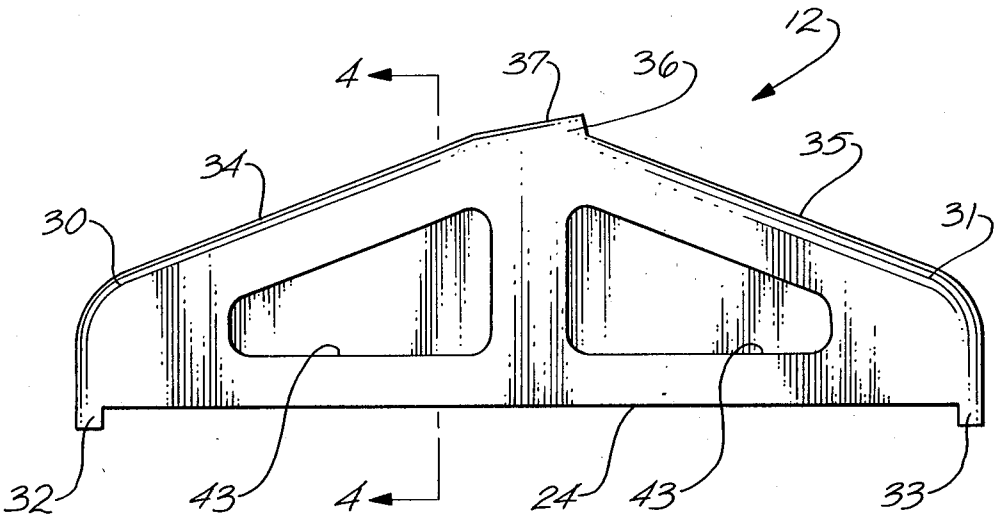
FIG. 3 is an elevation view of the hanger member which is a component of the hanger arrangement shown in FIG. 1.

As shown in FIGS. 3 and 4, hanger member 12 has opposite side surfaces 42 which are each recessed 43 in each of two areas toward the opposite ends of the hanger member from its midlength below wedging portion 36. The presence of recesses 43 in the opposite sides of the hanger member serve to reduce the weight of the hanger member without detracting from its structural characteristics. Also, the recesses cooperate with concrete 28, which is poured into cavity 19 after beam 10 has been supported on column 11, to key the hanger member in place in the cavity so that the hanger member remains fixed in its extended position in the cavity in intimate mating engagement with eye device 13 throughout the useful life of the building.

Eye device 13 is preferably fixedly carried by beam 10. The eye device preferably is located essentially entirely within cavity 19 and preferably has at least a portion of its structure embedded within the concrete of beam 10 close to beam end surface 18. The eye device is a significant structural component of beam 10 in the context of this invention because, as will be seen from an inspection of FIG. 1, the upward force applied to the eye device by the center portion of hanger member 12 in the completed connection of beam 10 to column 11 is greater (by about two times) than the upward force applied to the column end of the hanger member at bearing plate 25. The eye device and the associated load transfer means 17 receive and transfer to the beam the upward force applied to the eye device without displacement of the eye device relative to the beam. Eye device 13 and load transfer means 17 are intimately related to each other as cooperative components of hanger arrangement 15 and are securely connected to the overall structure of the beam so that the upwardly acting force applied to the eye device via the hanger member is effectively carried into and borne by the beam itself in the vicinity of the beam near end surface 18.

In the presently preferred embodiment of the invention shown in FIGS. 1 through 4, load transfer means 17 is comprised of a plurality of low-relax, multi-strand cables of the type which is commonly used in the manufacture of prestressed precast concrete building components for prestressing precast concrete beams and other precast or poured-in-place building components. In the arrangement shown in FIG. 1, five lengths 45 of low-relax prestressing cable, substantially conforming to ASTM Standard A416, are provided as major elements of load transfer means 17. Cables 45 can be ½-inch diameter, 270,000 pound test cable, each length thereof being approximately nine to ten feet long.

As shown in FIG. 2, the several cables 45 centrally of their ends pass through an enclosing metal sheath 46 which, with the cables therein, is bent into a U-shaped configuration having an upper return bend portion 47 centrally between depending legs 48 which have their lower ends embedded within the concrete of beam 10 immediately below the bottom surface of cavity 19 adjacent beam end surface 18. The spacing between the opposing faces of sheath legs 48 is slightly greater than the thickness of hanger member 12 as measured between its opposite side surfaces 42. The curvature of the inside, i.e., downwardly facing, surface of sheath return bend portion 47 corresponds closely to the curvature of top surface 37 of wedge portion 36 of the hanger member.

Sheath 46 can conveniently be defined, if desired, by a length of muffler pipe which is preliminarily partially flattened, while the pipe length is straight, to have a substantially flat rather than round passage therethrough, and through which the several cables 45 can be threaded in side-by-side relation. The generally flat sheath, with the cables 45 threaded therethrough, then can be placed in a press and bent to the desired U-shaped configuration shown in FIG. 2. Thereafter, the cable and sheath assembly can be coupled to a welded wire frame 49 which can be placed in the casting form for beam 10 at an appropriate place in the form in a desired relation to beam reinforcement members positioned in the form. The beam can then be cast around the reinforcement members and frame 49 in a known manner.

Frame 49 can conveniently be fabricated from a suitably sized piece of welded wire mesh. For example, frame 49 can be fabricated from a 4'×5' piece of four-gauge (0.225 inch diameter) welded wire mesh having 4"×4" mesh openings. Such a piece of wire mesh can be bent about the midpoint of its 5' dimension into a U-shaped preform (see FIG. 2) in which the distance between the preferably parallel major portions of the frame is slightly less than the distance between the opposing faces of sheath legs 48. As shown in FIGS. 1 and 2, sheath 46 can be placed with the ends of its legs straddling the return bend portion 50 of frame 49 at one end of the frame, and the cables 45 outside the sheath on either side of the frame can then be led along the adjacent major portions of the frame in a desired distribution of the cables along the frame. The cables, as distributed over the opposite sides of the frame, then can be secured to the frame, as by being tied at appropriate places to the frame wires. The frame, the cables and the sheath can then be placed as a unit into the desired position within a form for casting of beam 10 in association with other reinforcing elements which normally are placed in the form for embedment in concrete upon casting of the beam. Such beam reinforcing elements can include a pair of bottom bars 52 (such as number 9 reinforcing bars) and a pair of top bars 53 (such as number 7 reinforcing bars) disposed parallel to the length of the beam at appropriate places within it. The beam reinforcing elements also can include a suitable plurality of U-shaped stirrups 54 which extend from outwardly turned ends 55 located above beam top surface 20 into the beam to lie parallel to the beam side and bottom surfaces in the manner shown in FIG. 7. Additional reinforcing members of the beam can include suitable L-bars 56 in the bottom end portions of the finished beam. Other kinds and arrangements of reinforcing elements can be embedded in the beam in addition to or in place of those mentioned.

Workers skilled in the art to which this invention pertains will appreciate that pieces of welded wire mesh shaped similarly to frame 49 (see FIG. 2) are often used in the fabrication of prestressed precast concrete beams as devices for the positioning of prestressing cables 59 in the beam form prior to casting of the beam. As shown in FIG. 2, frame 49 can serve this additional function in beam 10, if desired. Frame 49 is a convenient and presently preferred way to place the ends of cables 45 in the desired positions within the beam form prior to casting of the beam, but is not required in all instances in the practice of this invention. Other suitable techniques can be used to support the opposite ends of cables 45 within the beam form for embedment within the beam upon casting of the beam.

In placing frame 49 with cables 45 and sheath 46 connected thereto in a form for casting of beam 10, care is taken to cause the sheath to lie at the appropriate angle of inclination from the vertical so that the downwardly facing bottom surface of sheath return bend portion 47 has the desired slope for registration with surface 37 of hanger member 12 at the time the hanger member is moved to its extended position to mate with sheath 46 and to cause the column end of the hanger member to project in cantilever manner from the end of the beam. In view of the foregoing, it is apparent that, in the presently preferred embodiment of this invention shown in FIGS. 1 through 4, the central return bend bight portions of the several cables 45 and sheath 46 cooperate to define eye device 13 which provides opening 38 into which the hanger member is movable for mating engagement with the eye-device.

Cavity 19 preferably is provided centrally in the top end portion of beam 10. The cavity preferably has a length along the length of the beam which is sufficient to accommodate hanger member 12 fully within the cavity in a retracted position of the hanger member relative to the beam; the retracted position of the hanger member is shown in broken lines in FIG. 1. Preferably, when the hanger member is in its retracted position in cavity 19, the column end 30 of the hanger member is disposed within eye device opening 38.

Also, in the preferred practice of this invention, in preparing the beam for casting, a steel bearing plate 60 is prepositioned in the form cavity on the side of eye device 13 opposite from beam end surface 18 in such position that the bearing plate is engageable by hanger member bottom surface 24 in the extended position of the hanger member relative to the beam (see FIG. 1). As shown in FIG. 1, it is preferred that the bottom surface of cavity 19 between bearing plate 60 and column end surface 18 is substantially coplanar with, or slightly below, the top surface of bearing plate 60. If desired, beam bearing plate 60 can be carried on the ends of a pair of parallel reinforcing rods 58, such as 4½-foot-long No. 9 reinforcing rods, disposed inside and carried by the return bend portion 50 of welded wire frame 49 as shown in FIG. 1.

Workers skilled in the art to which this invention pertains will readily appreciate how a casting form for beam 10 can be constructed to define cavity 19 and to place eye device 13 and bearing plate 60 in the appropriate positions in the form cavity. Also, as noted above, it is preferred that beam 10 be a prestressed precast beam, and workers skilled in the art will readily appreciate how prestressing of the beam can be achieved.

Column 11 can be a precast concrete column fabricated remote from the site of its use to define recess 22 with bearing plate 25 and then erected upon suitable foundations at the desired building site. Alternatively, if desired, column 11 can be a cast-in-place column formed on suitable foundations at the building site. In any event, the connection of beam 10 to column 11 presumes that column 11 is already in place when beam 10 is to be connected to the column. It is also understood that the opposite end of the beam can be a substantial mirror image of the end of the beam shown in FIG. 1, and thereby also have a cavity 19, eye device 13, and related structure defined in it for connection of the opposite end of the beam to another column by a hanger arrangement which is substantially identical to hanger arrangement 15 as shown in FIG. 1.

Before beam 10 is lifted into position between its supporting columns, a hanger member 12 is inserted into each upper end cavity 19 of the beam so that the hanger member is disposed entirely within the corresponding cavity and has its column end 30 loosely disposed in opening 38 of the corresponding eye-device 13. The eye device opening in each instance is disposed substantially in a plane oriented preferably transversely of the length of the beam. Each hanger member, as initially placed in its beam cavity, preferably is disposed substantially parallel to the length of the beam. The beam is then lifted into position between its supporting columns to a point at which the beam ends are slightly above the final position of the beam relative to the columns, with the open ends of beam cavities 19 substantially aligned with column recesses 22. The hanger members at the opposite ends of the beam are then moved, as by being manually pushed, from their retracted positions wholly within the cavities to their extended positions in which each hanger member has its wedging portion 36 snugly mated with the upper portion of the adjacent eye device, and so that the column ends of the hanger members project into column recesses 22 above bearing plates 25. The lateral position of the beam, as so suspended with its hanger members projecting into the column recesses, is adjusted as needed so that the downward projections 32 on the column ends of the hanger members lie inwardly in the recess from the adjacent column bearing plates 25. The beam is then lower into its final position between the columns so that the dead weight of the beam is supported by the hanger members, with the upward force on the projecting ends of the hanger members being counteracted by the snug engagement of the hanger members with the eye devices. When the hanger members are so engaged with the column bearing plates, hanger member projections 32 depend below the far sides of the bearing plates and prevent any significant movement of the hanger members back into the adjacent beam cavities. In this manner, the beam is safely and securely supported between the columns and cannot fall from its connected position between the columns in the event that it is bumped in the course of further construction work on the appropriate building.

In a typical construction process, forms for pouring of floor slab !6 are then erected between adjacent columns and beams. When floor slab 16 is actually poured, some of the poured concrete flows into each cavity 19 and column recess 22 to fill the same and to embed the adjacent eye device and hanger member, thus to permanently lock the hanger member in its extended and beam supporting position.

Cables 45, used to define load transfer means 17 in beam 10, can be provided from odd lengths of such cable which are commonly left over from prestressing processes in facilities manufacturing prestressed precast concrete beams and the like.

Sheath 46 is a preferred, but not required, component of eye device 13. The sheath provides a convenient way to gather the bight portions of the several individual cables together for load transferring engagement of the cables with hanger member 12 in the manner described above. If a sheath is not used to enclose the bight portions of cables 45 within cavity 19 upon casting of beam 10, the bight portions of the cables can be left loose relative to each other in the cavity; it is more preferred that they are at least loosely tied together, by light wire or the like, so that they are grouped in juxtaposed parallel relation to each other at the time the hanger member is moved in the cavity from its retracted to its extended position.

Figure 5:
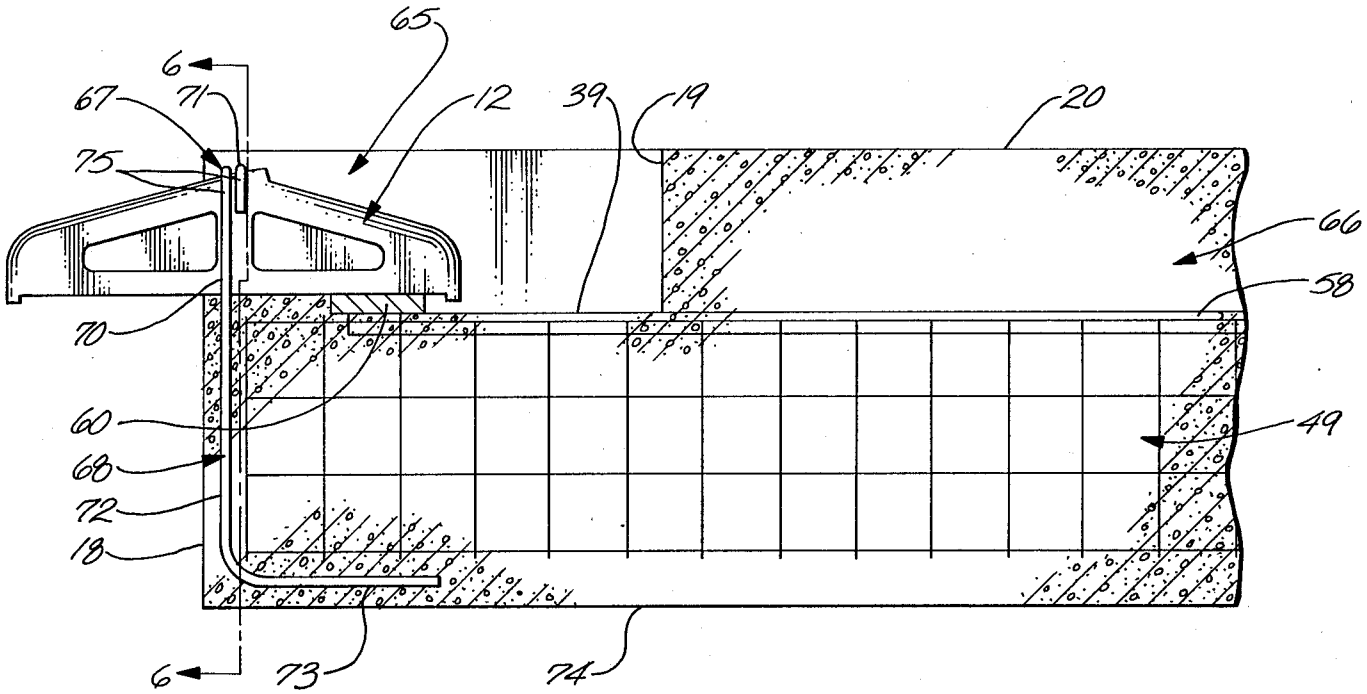
FIG. 5 is a simplified fragmentary cross-sectional elevation view of the beam and hanger member components of another hanger arrangement according to this invention.
Figure 6:
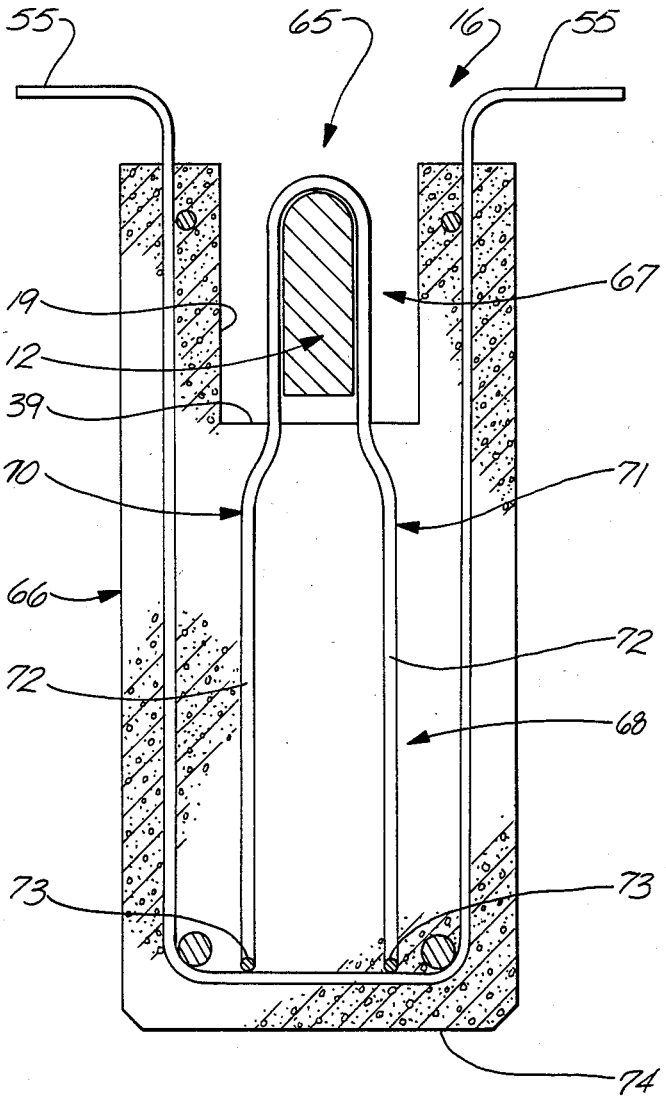
FIG. 6 is an enlarged simplified cross-sectional elevation view taken along line 6—6 of FIG. 5.

FIGS. 5 and 6 show another retractable beam hanger arrangement 65 according to this invention in connection with a preferably prestressed, precast concrete beam 66. Hanger arrangement 65 is similar to hanger arrangement 15 shown in FIGS. 1 and 2 except for the manner of definition of eye device 67 and load transfer means 68 of arrangement 65 which differs from that of arrangement 15; in all other respects arrangement 65 and beam 66 can be like arrangement 15 and beam 10, and so similar reference numerals are used in FIGS. 5 and 6 as are used in FIGS. 1–4 where the structural features shown are the same. It will be understood that the internal reinforcements of beam 66 can be the same as or quite different from those of beam 10, depending upon the design philosophy used in design and manufacture of the beam and the loads it will carry in use. It is also understood that beam 66 is to be supported between building components which, at appropriate places, define recesses and bearing plates like or similar to column recess 22 and bearing plate 25 shown in FIG. 1.

Hanger arrangement 65 includes a hanger member 12, as described above, which is movable between retracted and extended positions in a cavity 19, as described above, formed centrally in an end portion of beam top surface 20 so that the cavity opens to beam end surface 18. Eye device 67 and load transfer means 68 of hanger arrangement 65 are defined by the upper and lower portions, respectively, of at least a pair 70, 71 of preferably heavy lengths of concrete reinforcing bar. Each bar 70, 71 has a vertical portion 72 within beam 66 near beam end surface 18 and a lower horizontal portion 73 which preferably extends a desired distance along the length of the beam above its bottom surface 74. The vertical portion of each bar 70, 71 extends into cavity 19 to a return bend end 75 preferably centrally within the width of the cavity and preferably within the height of the cavity. Each bar end 75 has an inverted U-shape which is dimensioned and contoured for intimate mating engagement with top surface 37 of wedge portion 36 of hanger member 12 in the extended position of the hanger member relative to the beam. The distance between bars 70, 71 below their bent ends is slightly greater than the width of the hanger member, so that the bars in the cavity cooperate to define an opening 77 similar to opening 38 of hanger arrangement 15 and within which the hanger member is movable to its extended position. Bars 70, 71 below cavity 19 can have any spacing between them which may be desired.

The portions of bars 70, 71 which lie within cavity 19 comprise the eye device of hanger arrangement 65. The portions of the bars which are embedded within beam 66 comprise the load transfer means of the hanger arrangement.

If desired, bars 70, 71 can be extended horizontally in the beam any distance desired as embedded reinforcement members serving the purposes, for example, of bottom reinforcement elements 52 of beam 10 (see FIG. 2). Also, if desired, the eye device and load transfer means of another hanger arrangement 65 at the opposite end of beam 66 can be defined at the opposite ends of such extensions of bars 70, 71.

It will be apparent that hanger arrangement 65 is used in the same manner as hanger arrangement 15, described above, and provides the same benefits and advantages over presently known beam hangers or support arrangements.

Beam hanger arrangements according to this invention provide the advantages and benefits over haunch-type beam supports which have been described above. Hanger members 12 apply the dead and live loads of the beams to columns 11 inside the columns, not to lateral appendages defined by the columns. The present hanger arrangements apply the beam loads to the columns substantially more axially to the columns, and substantially less eccentrically to the columns than is the case with haunch beam supports. Also, the hanger members can bear in their receiving recesses in columns and the like upon steel bearing plates. The hanger members can have smooth bearing surfaces, so sound metal-to-metal contact between bearing plates and hanger members can be achieved reliably and economically to provide good load supporting and transferring cooperation between them. Elastomeric bearing surfaces, which often present their own problems occasioning difficult and costly repairs, can be eliminated.

Also, the retractability of hanger arrangements according to this invention into the beams with which they are used provides advantages and benefits over beam hanger arrangements which rely upon fixed beam hangers projecting in cantilever manner beyond the ends of beams as precast. An example of a fixed cantilever-style beam hanger is a Cazaly hanger, a design for which is set forth as pages 6–35 and 6–36 of PCI Design Handbook, Third Edition, published by Prestressed Concrete Institute, Chicago, Ill. Such fixed cantilever-style beam hangers present obvious problems in mounting beams incorporating them between supporting columns. Among other things, beams incorporating fixed cantilever-style beam hangers must be handled very carefully in being moved from their sites of manufacture to the positions of final placement, else the projecting hangers can become damaged. Such beams are also more difficult to maneuver into their supported positions. Further, such fixed cantilever-style beam hangers are used with column ledges or haunches, or in situations where the beam is supported on shoring as the other building structures which will cooperate with such hangers are constructed adjacent the positioned beam. Also, Cazaly hangers and the like extend only short distances (about three inches) beyond their beam ends and so provide little or no meaningful impact upon the problem of eccentric column loads. The present beam hangers, on the other hand, can extend substantial distances (seven inches or more) from the adjacent beam ends for applying beam loads to columns significantly within the sides of a column and within the extent of column reinforcing networks. The present hangers can be sized to meaningfully reduce eccentric loads upon columns and the like.

Workers skilled in the art to which this invention pertains will readily appreciate that the preceding descriptions, presented principally with reference to the presently preferred form of the invention, is illustrative and exemplary in nature and is not an exhaustive catalog of all forms in which the structural and procedural aspects of this invention can be manifested or practiced. For that reason, the following claims are to be construed and interpreted as broadly and comprehensively as is consistent with the state of the relevant art and technology existing at the pertinent time.

What is claimed is:

1. A hanger arrangement for load transferring connection of a reinforced concrete beam and the like to a reinforced concrete column and the like, comprising a reinforced concrete beam and, at least at one end of the beam, a hanger member movable in a cavity in an end portion of the beam between a retracted position in which the hanger member is disposed within the cavity and an extended position in which a column end portion of the hanger member extends in cantilever manner from the cavity and the end of the beam for bearing upon a selected feature defined in a recess in a column to which the beam is connectible, the beam further defining in the cavity, for cooperation with a selected upper central portion of the hanger member in the extended position thereof, a hanger eye device coupled in fixed load bearing relation to the beam and defining an opening in which the hanger member is movable in movement from its retracted to its extended position, the beam also defining in the cavity a bearing pad engageable with an underside of the hanger member in the extended position thereof adjacent an opposite end of the hanger member.

2. Apparatus according to claim 1 wherein the opening in the hanger eye device is contoured for substantially mating cooperation with a central portion of the hanger member in the extended position of the hanger member.

3. Apparatus according to claim 1 including load transfer means connecting the hanger eye device to adjacent portions of the beam for transfer of loads applied to the hanger eye device into the beam.

4. Apparatus according to claim 3 wherein the beam includes reinforcing members embedded therein, and wherein the load transfer means includes a portion in the cavity of at least one of the reinforcing members.

5. Apparatus according to claim 3 wherein the load transfer means comprises at least one length of multistrand cable having a central bight portion disposed in the cavity and opposite end portions disposed in a predetermined manner in the beam.

6. Apparatus according to claim 5 wherein the opposite end portions of the cable are connected in the beam to reinforcing members embedded in the beam.

7. Apparatus according to claim 5 wherein the load transfer means comprises a plurality of said cables.

8. Apparatus according to claim 5 wherein the cable substantially conforms to ASTM Standard A416.

9. Apparatus according to claim 5 wherein the cable in the cavity is enclosed in a sheath with which the hanger member is engaged in the extended position of the hanger member.

10. Apparatus according to claim 1, wherein the hanger member is movable in the cavity substantially linearly along a path substantially aligned with the length of the beam.

11. Apparatus according to claim 1 wherein the hanger member at the column end thereof includes a retainer projection cooperable with the contour of the recess upon bearing of the hanger member upon the selected feature in a column recess for retaining the hanger member in its extended position.

12. Apparatus according to claim 11 wherein the selected feature in a column recess comprises a bearing pad, and the retainer projection is cooperable with an edge of the column bearing pad.

13. Apparatus according to claim 1 wherein the hanger member is defined for loading in use substantially as a centrally loaded simply supported beam.

14. A reinforced concrete beam comprising a cavity in an upper end surface of the beam, the cavity being open to an end surface of the beam and being elongated substantially in the direction of the length of the beam, the cavity having a bottom surface, a structural eye device extending within the cavity adjacent the beam end surface from the cavity bottom surface and disposed generally in a plane oriented transverse to the length of the beam, and load transfer means connected to the eye device and disposed within the beam for transfer to the beam of loads applied in use of the beam according to a design philosophy which regards the eye device as a principal support for the beam in use.

15. A reinforced concrete beam according to claim 14 including a metal plate in the cavity bottom surface proximate the eye device on the side thereof opposite from the beam end surface.

16. The combination with a reinforced concrete beam according to claim 14 of a structural metal hanger member, the hanger member being disposable in the cavity for motion between a retracted position in which the hanger member is disposed substantially in the cavity and an extended position in which an end portion thereof projects in cantilever manner from the cavity beyond the beam end surface and is engaged in substantial mating relation with the eye device in such manner that an upward force applied to the projecting end portion of the hanger member is resisted by the eye device and is transferred into the beam by the load transfer means.

17. The combination according to claim 16 wherein the hanger member is cooperatively configured with the eye device for wedging of the hanger member in the eye device in the extended position of the hanger member.

18. The combination of claim 16 wherein the hanger member is an elongate member having an opposite end portion, and including a plate in the cavity bottom surface engagable with the opposite end portion of the hanger member in the extended position thereof.

19. A method for supporting an end of a reinforced concrete beam by a column and the like in use of the beam in a structure of which the beam is a component, the method comprising the steps of:

(a) providing in an upper portion of the beam adjacent the end thereof a structural eye device having an opening disposed substantially in a plane oriented substantially transversely of the elongate extent of the beam, the eye device being carried by the beam sufficiently securely that the eye device can accept and transfer into the beam substantial upward loads consistent in magnitude with in-use beam end support loads;

(b) providing in the column, at the location therealong occupied by the beam end when the beam is in place in the structure, a recess having therein a beam support member structurally interrelated to the column;

(c) placing the beam substantially in its intended position in the structure with the beam end proximately adjacent the recess;

(d) engaging through the eye device opening and in mating contact with the eye device a beam hanger member which projects in cantilever manner from the beam end into the recess; and (e) moving the beam with the hanger member extended therefrom so that the projecting portion of the hanger member engages the beam support member for support of the beam thereby and for transfer of beam support loads into the beam via the hanger member and the eye device.

* * * * *